US006174026B1

(12) United States Patent
Wise

(10) Patent No.: US 6,174,026 B1
(45) Date of Patent: Jan. 16, 2001

(54) CONVERTIBLE HASSOCK

(76) Inventor: James H. Wise, 2346 Patuxent River Rd., Gambrills, MD (US) 21054

( * ) Notice: Under 35 U.S.C. 154(b), the term of this patent shall be extended for 0 days.

(21) Appl. No.: 09/418,131

(22) Filed: Oct. 14, 1999

Related U.S. Application Data

(60) Provisional application No. 60/104,501, filed on Oct. 16, 1998.

(51) Int. Cl.[7] ..... A47C 13/00

(52) U.S. Cl. ..... 297/120; 297/108; 297/423.41; 108/17; 108/69

(58) Field of Search ..... 297/108, 109, 297/119, 120, 121, 188.1, 423.41; 108/13, 17, 69, 70; 5/3, 4, 661

(56) References Cited

U.S. PATENT DOCUMENTS

| | | | | |
|---|---|---|---|---|
| 126,266 | * | 4/1872 | Coates | 5/3 |
| 138,840 | * | 5/1873 | Bayles et al. | 297/108 |
| 1,309,097 | * | 7/1919 | Markwick | 297/188.1 |
| 2,592,912 | * | 4/1952 | Knipper | 297/188.1 |
| 2,812,227 | * | 11/1957 | Hill | 297/188.1 |
| 3,650,562 | | 3/1972 | Adler . | |
| 3,667,803 | | 6/1972 | Ford . | |
| 4,539,977 | | 9/1985 | Schneider, Sr. . | |
| 5,727,844 | * | 3/1998 | O'Quinn et al. | 297/188.1 |
| 5,893,182 | | 4/1999 | Sutherland et al. . | |

FOREIGN PATENT DOCUMENTS

| | | | | |
|---|---|---|---|---|
| 19200 | * | 8/1909 | (GB) | 297/109 |

* cited by examiner

*Primary Examiner*—Peter R. Brown
(74) *Attorney, Agent, or Firm*—Shoemaker and Mattare, Ltd.

(57) ABSTRACT

A convertible hassock has a base whose walls enclose a storage area, a flat lid which covers the storage area, and at least one seat which is hinged to one of the walls. The seat can be pivoted from an outboard position resting on top of the lid, to an outboard position substantially coplanar with the lid. The seat is supported, in its open position, either by a cantilever construction or by a prop which engages the floor. The seat has a cushioned side and a flat panel side. The cushion is uppermost when the seat is folded inward, to provide a hassock function, and the panel side is uppermost when the seat is folded outward, providing an extended table surface. While the seats are folded outward, the lid can be raised to permit access to the storage area beneath.

2 Claims, 7 Drawing Sheets

CONVERTIBLE HASSOCK

This application is related to provisional patent application 60/104,501, filed Oct. 16, 1998.

BACKGROUND OF THE INVENTION

This invention relates to an article of furniture which may serve as a hassock, a storage chest, or a flat top coffee table.

Cushioned ottomans, hassocks or footstools serve as a place to rest the feet while one sits on a chair or sofa. It frequently is desired to place food and beverage items on a flat top surface such as a coffee table, typically near the same spot occupied by the ottoman. Additionally, it may be desired to store articles such as blankets in the sitting area. A single composite or convertible article of furniture embodying all the mentioned functions would save space, and would have advantages of economy and ease of use over separate pieces of furniture for performing these three functions.

Some prior inventors have proposed convertible furniture items having the form of an ottoman. See, for example, U.S. Pat. No. 2,812,227.

Prior convertible articles of furniture suffer at least one of the following limitations: (1) none provides the triple function of a footrest, storage chest and flat-top coffee table; and (2) many have complication constructions comprising springs, hooks, latches, brackets, and other hardware which tend to increase both the cost and potential for mechanical failure or wear.

SUMMARY OF THE INVENTION

An object of the invention is to provide a convertible article of furniture capable of performing three separate functions—footrest, table and storage device—within a single article of furniture.

Another object is to permit the user to have simultaneously a flat table top and a footrest position so as to enable one to rest the feet while at the same time food or beverages are supported on the article.

A further object is to provide a convertible article of furniture having a minimum number of parts, thus to minimize cost and complexity, and to avoid maintenance problems.

These and other objects are attained by a convertible hassock having a plurality of walls enclosing an area, a flat lid which covers the enclosed area, and is supported by at least some of said walls, and at least one seat which is hinged to one of said walls, and can be pivoted between an outward position seated on top of said lid, and an inward position substantially coplanar with said lid. The seat is supported, in its open position, either by a cantilever construction or by a prop which engages the floor. The seat has a cushioned side and a flat panel side. The cushion is uppermost when the seat is folded inward, to provide a hassock function, and the panel side is uppermost when the seat is folded outward, providing an extended table surface. While the seats are folded outward, the lid can be raised to permit access to the storage area beneath.

BRIEF DESCRIPTION OF THE DRAWINGS

In the accompanying drawings.

DESCRIPTION OF THE PREFERRED EMBODIMENT

Figure 9:
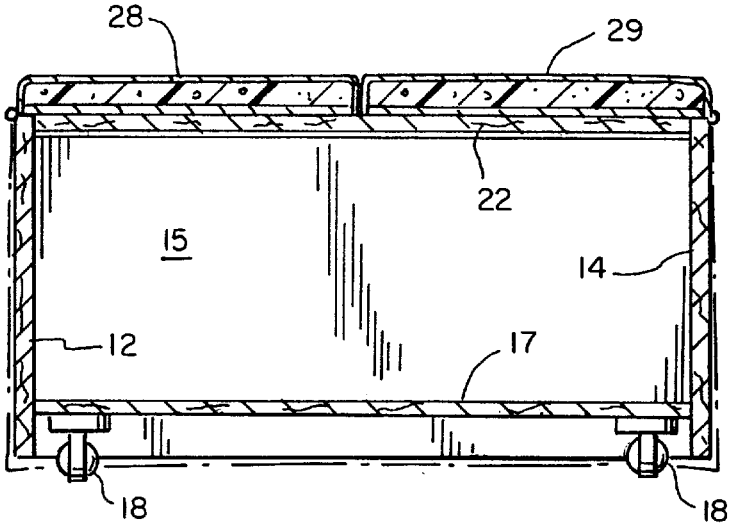
FIG. 9 is a sectional view, taken on a vertical plane, of the embodiment of FIG. 1, showing hidden elements.

A convertible hassock embodying the invention comprises a stationary base 10, which is essentially a right rectangular prism having four vertical walls 12, 13, 14, 15 (FIG. 3) and a floor 17 (FIG. 9) extending between the walls, near their bottom edges. Casters 18 may be attached to the bottom surface of the floor, to give the hassock mobility. A receptacle 20 useful as a magazine rack may be attached to the outside of one or both end walls 12,14. The outer surfaces of the walls may be covered or draped with fabric 21.

Figure 2:
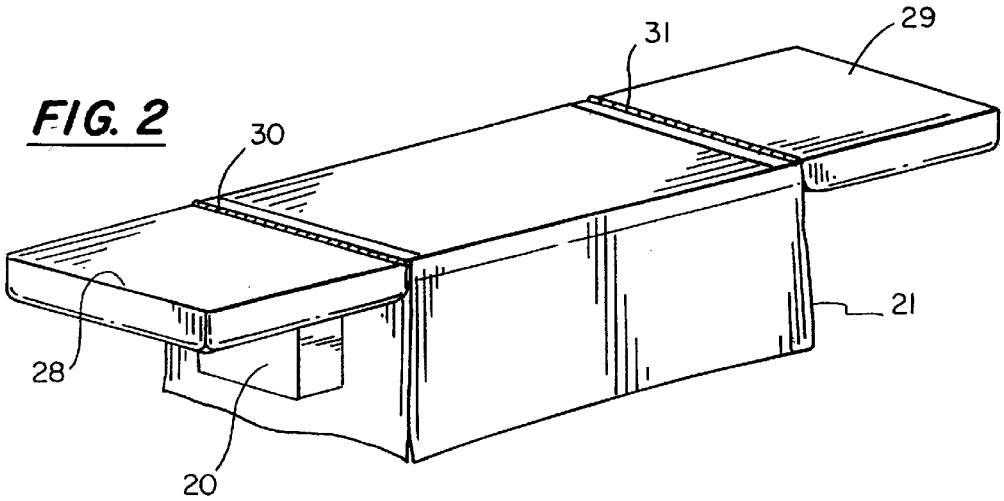
FIG. 2 is a view like FIG. 1, showing the article in its open, table top configuration.
Figure 3:
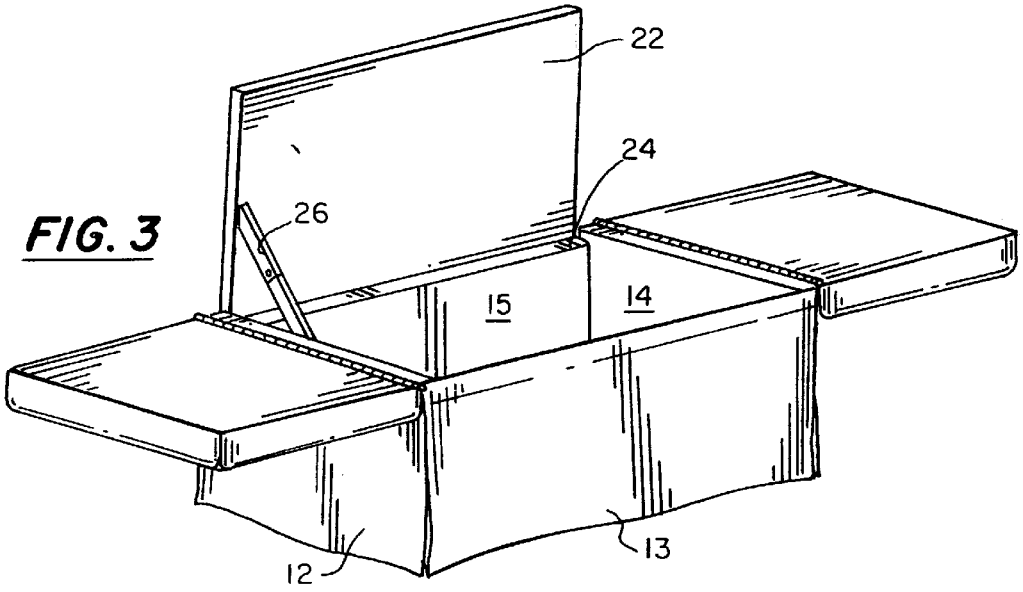
FIG. 3 is a view like FIG. 2, showing the lid open, exposing the storage area.
Figure 4:
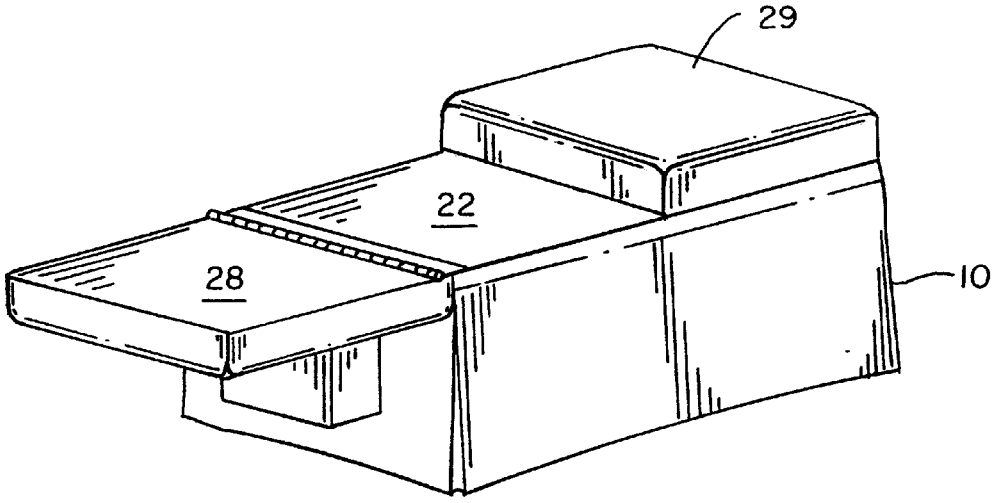
FIG. 4 is a view like FIG. 2, showing only one of the two seats opened.
Figure 8:
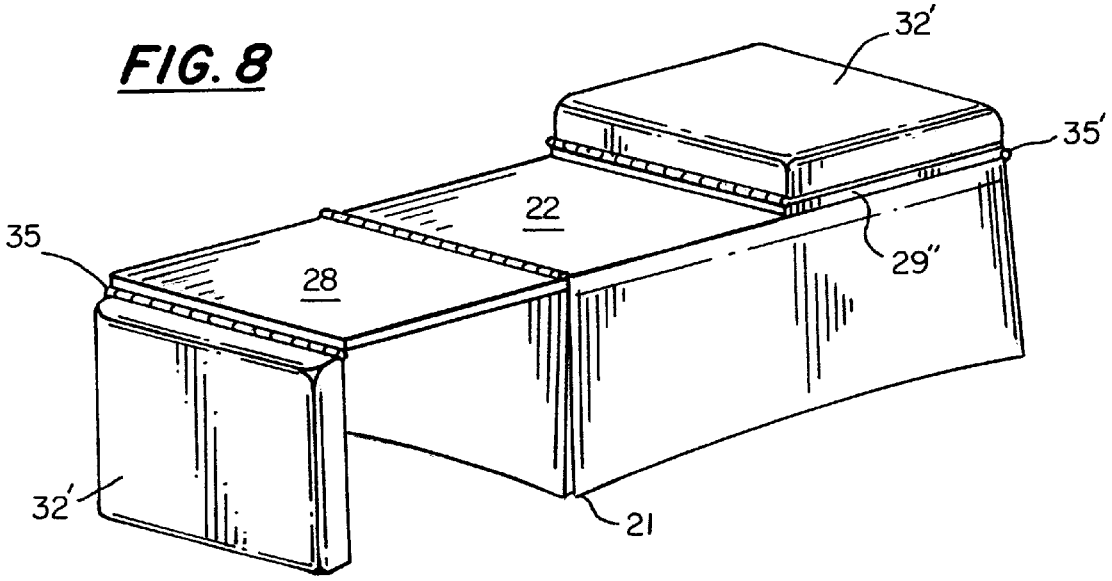
FIG. 8 is a view like FIG. 7, with the lid closed and one of the seat panels folded upon the lid.

A lid 22 is supported by a hinge (or hinges) 24 extending along the upper edge of one of the side walls in such a way that the lid can be raised from a closed, horizontal position (FIG. 2) to a substantially vertical open position (FIG. 3). A folding brace 26 prevents the lid from closing accidentally.

Figure 1:
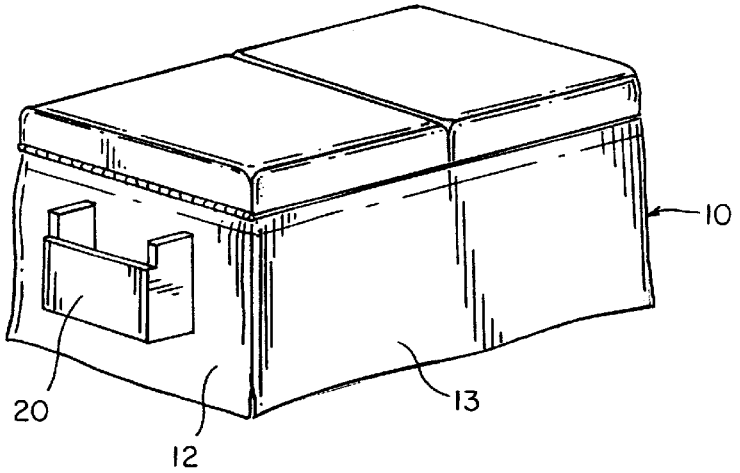
FIG. 1 is a perspective view, from the front, of a convertible hassock embodying the invention, shown in its closed, footrest configuration.

A pair of padded seat panels 28,29 are attached by respective hinges 30,31 to each of the end panels 12,14. The hinge type and position is chosen so that the seat panels can fold 180° outward from a closed position (FIG. 1), covering the lid (when the latter is itself closed), to an open position (FIG. 2) allowing the lid to be raised (FIG. 3). The magazine receptacle 20, if present, serves to support the corresponding seat panel in this open position; otherwise, suitable bracing (not shown) may be added to prevent overloading the hinge.

Figure 5:
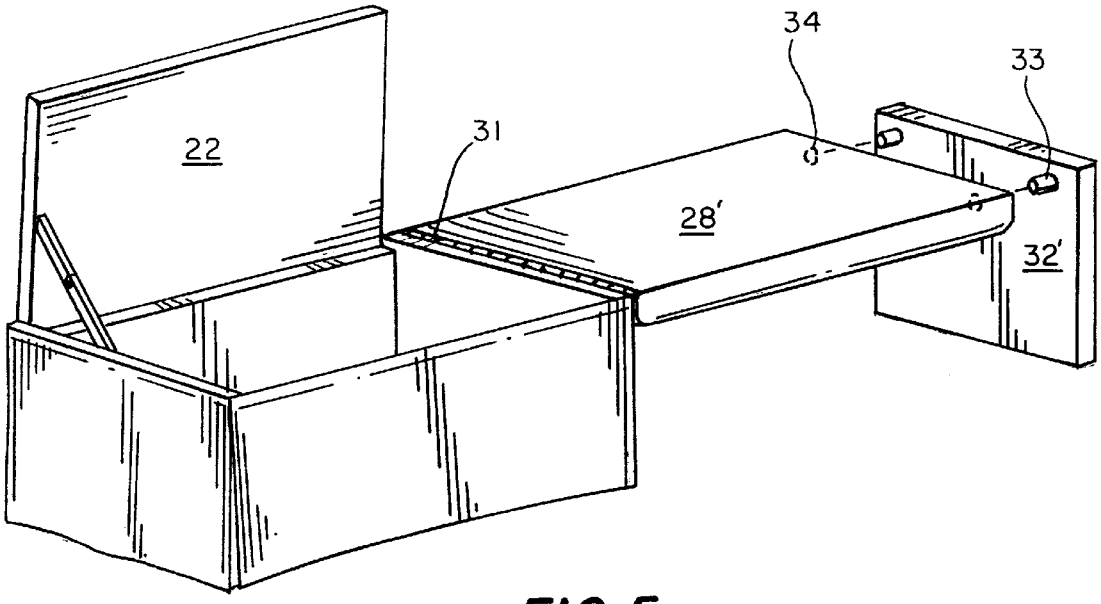
FIG. 5 is a view like FIG. 3, of a modified form of the invention, which has but a single seat panel that opens to one side and is supported by an end prop.
Figure 6:
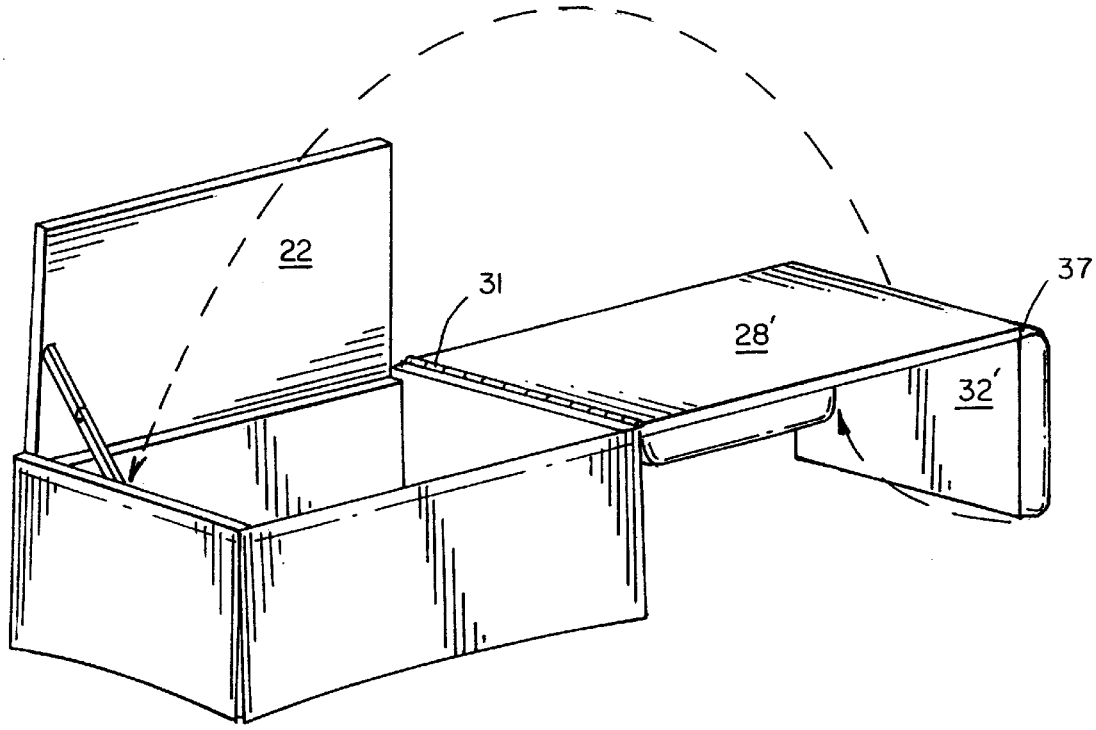
FIG. 6 depicts a slightly modified form of the invention of FIG. 5.
Figure 7:
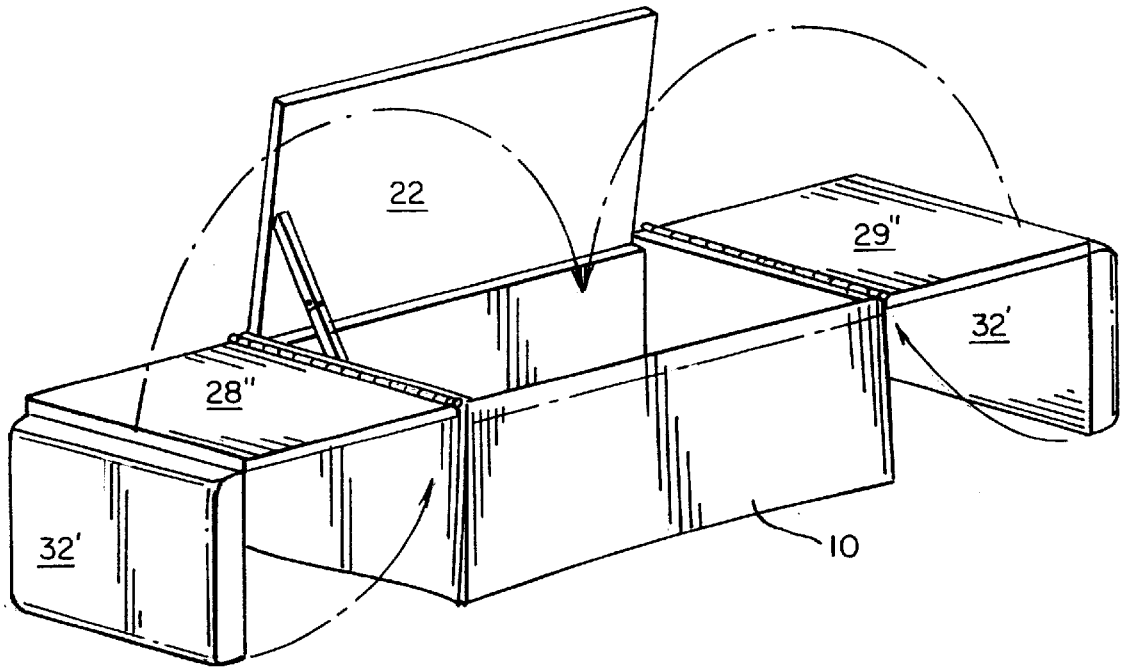
FIG. 7 is a view like FIG. 3, showing a further form of the invention, in which both seat panels include an articulated, cushioned end prop.

Another way of supporting the open seat panel is by adding an end support panel 32, variations of which appear in FIGS. 5–8 and 10–14. In FIGS. 5 and 6, there is only one seat panel 28', but it has a length sufficient to completely cover the lid. In both of these variations, the free end of the folding panel is supported by a ground-engaging prop at the end of the folding panel. The prop is a removable member in FIG. 5, having a pair of dowels 33 that are inserted into holes 34 in the free end of the folding panel, while in FIG. 6, the prop is a cushioned seat 32' which is connected by a hinge 37 to the free end of the folding panel.

Figure 10:
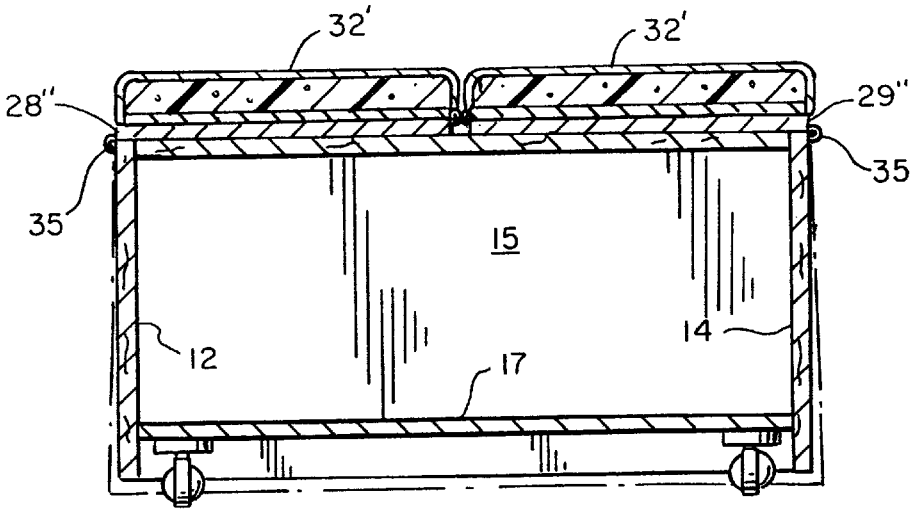
FIG. 10 is a sectional view, taken on a vertical plane, of the embodiment of FIG. 7.
Figure 11:
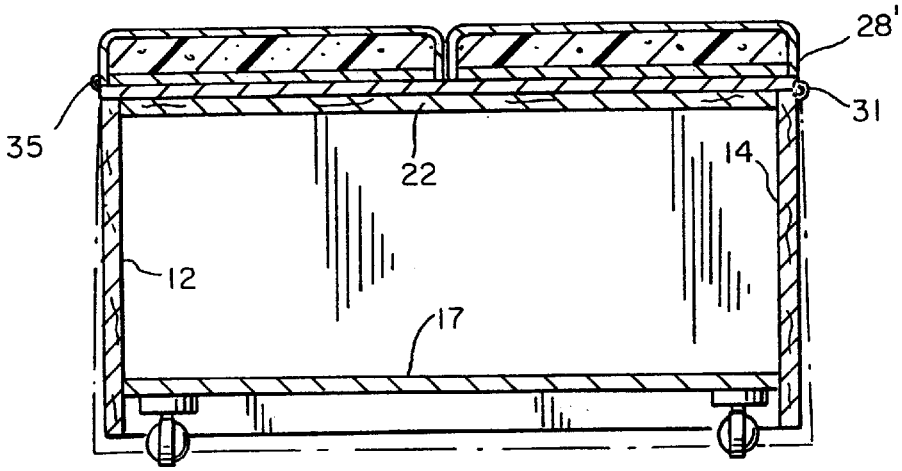
FIG. 11 is a sectional view, taken on a vertical plane, of the embodiment of 6.

In FIG. 5, the entire panel is padded. The FIG. 6 construction permits the end supporting seat 32' to be folded inward, once the panel 28' has been closed over the lid, to form a completely padded surface. In the embodiment of FIG. 8, there are once again two seat panels 28", 29" but each has its own padded end support panel 32', connected by a hinge 35, which engages the ground to act as a prop when the seat panel is open, and folds flat once the panels 28", 29" have been closed over the lid, as shown in FIGS. 10 and 11.

Figure 12:
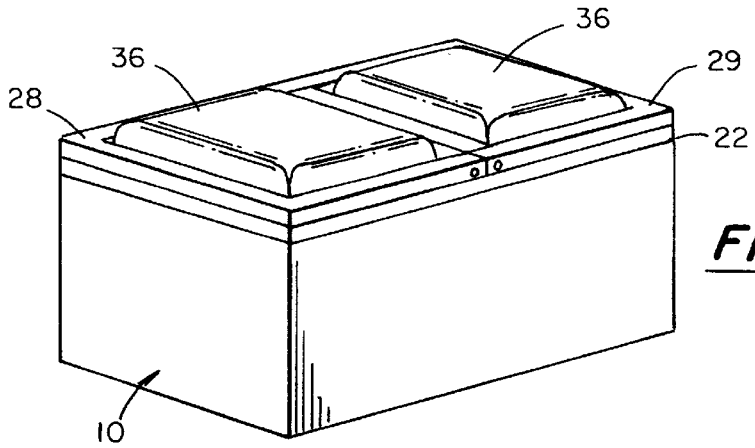
FIGS. 12–14 show a further embodiment of the invention, where the seat cushions are surrounded by open frames which fold outward to serve as end props.
Figure 13:
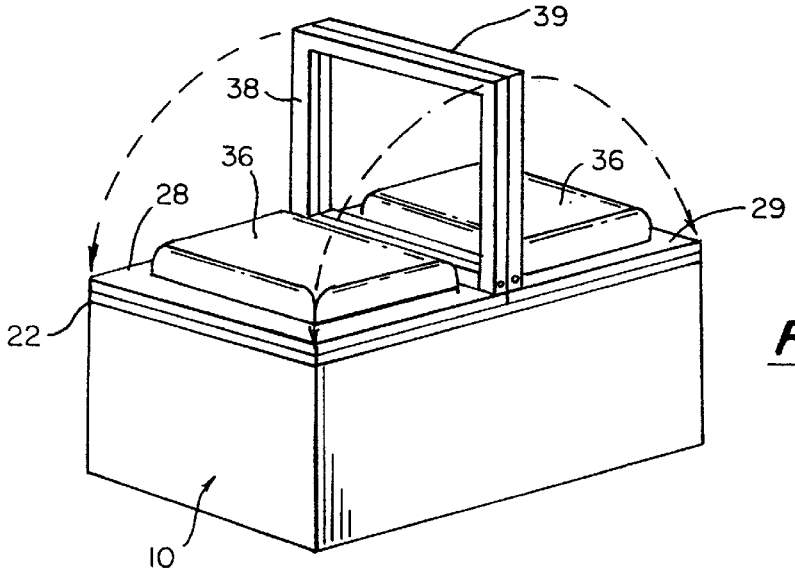
Figure 14:
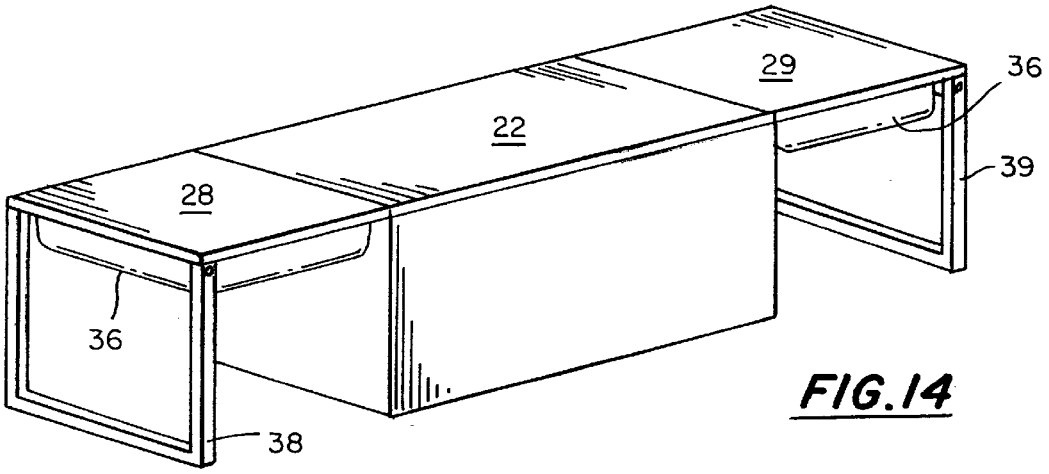

FIGS. 12–14 show an alternative form of the invention, in which the end props are not solid panels, but rather open rectangular frames 38, 39. As one can see from FIGS. 12 and 13, the seat cushions 36 are designed in this case somewhat smaller than in the previous embodiments, with a margin all around sufficient to permit the rectangular frames 38, 39 to abut against the unupholstered flat surfaces of the seats 28, 29 forming the margins.

Figure 15:
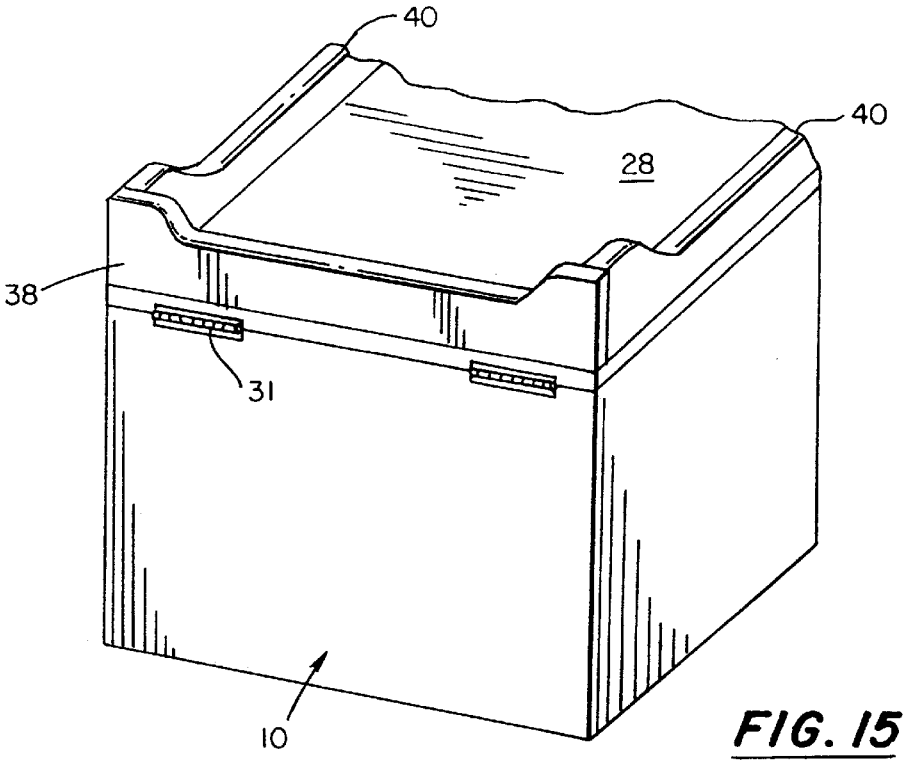
FIGS. 15 and 16 are fragmentary views showing a cantilevered panel closed and opened, respectively.
Figure 16:
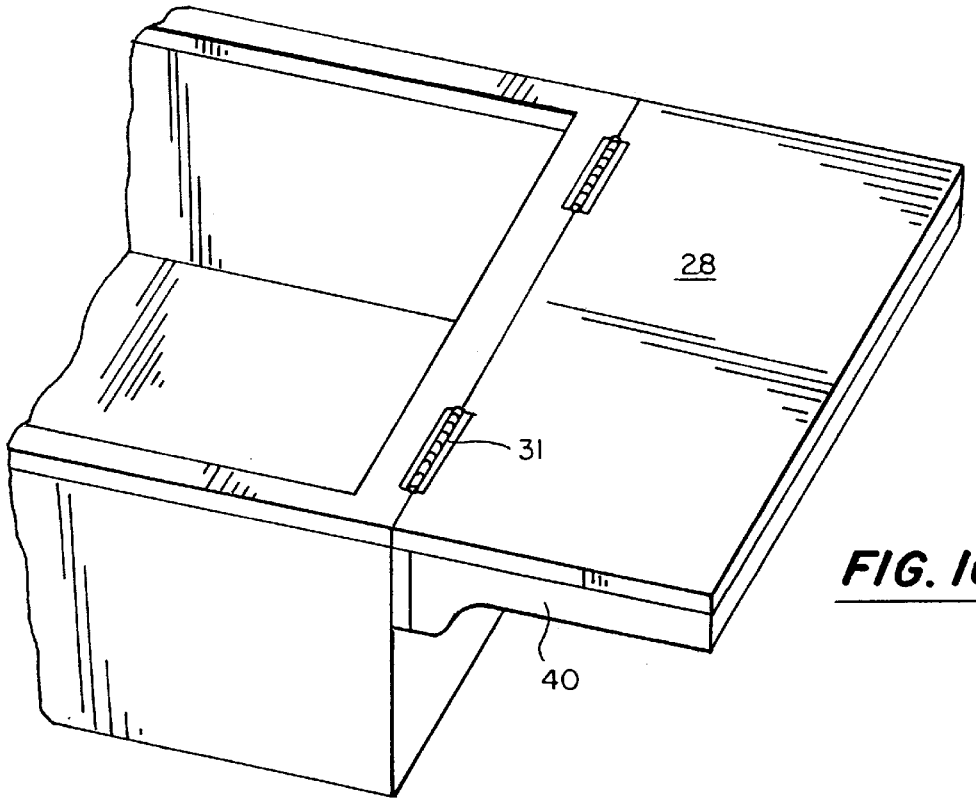

FIGS. 15 and 16 illustrate a modification which may be applied to various of the embodiments of this invention, particularly those (e.g., FIGS. 1–3) lacking an end prop and thus having only cantilever support. One may note that the seat panel 28 of FIGS. 15 and 16 is reinforced by peripheral framing members 40, and that those extending perpendicular to the hinges have a non-uniform cross-section which is greater at the hinge end to reduce the forces pulling on the hinges 31, thus to reduce the likelihood of hinge damage from overload in case heavy items are placed on the seat panels when they are open.

In use, the invention may be converted from a hassock (for example, FIG. 12) to a coffee table (FIG. 14) simply by first raising the props into a locked position and then pivoting the seat panels 28, 29 180° outward to their extended position, where their uncushioned surfaces are substantially coplanar with the upper surface of the closed lid. One now has a coffee table. In this configuration, the lid 22 can be raised (for example, FIG. 3)—and braced in the open position if desired—to gain access to the interior of the unit, which is useful for storing blankets or other articles.

Since the invention is subject to modifications and variations, it is intended that the foregoing description and the accompanying drawings shall be interpreted as only illustrative of the invention defined by the following claims.

I claim:

1. A convertible hassock comprising a prismatic frame having vertical walls surrounding an interior volume, a lid connected to one of said walls by a first hinge so that the lid can pivot between a closed, horizontal position in which it is supported by a least one other of said walls, and an open, substantially vertical position providing access to said interior volume, at least one seat panel connected to another of said walls by a second hinge so that the seat panel can pivot between a horizontal inboard position on top of, parallel to and supported by the closed lid, and an horizontal outboard position substantially coplanar with the closed lid, a prop connected by a further hinge to the outer free edges of the seat panel for supporting said seat panel in its horizontal outboard position, wherein said prop is an open frame and said seat panel has a cushion which is uppermost when the seat panel is in its horizontal inboard position, said cushion being sized to extend through and above the open frame when the latter is folded flat against the seat panel.

2. The invention of claim 1, further comprising a horizontal floor extending between said walls and defining the bottom of said interior volume.

* * * * *